US006861791B1

(12) United States Patent
Givargizov et al.

(10) Patent No.: US 6,861,791 B1
(45) Date of Patent: Mar. 1, 2005

(54) STABILIZED AND CONTROLLED ELECTRON SOURCES, MATRIX SYSTEMS OF THE ELECTRON SOURCES, AND METHOD FOR PRODUCTION THEREOF

(75) Inventors: Evgeny Invievich Givargizov, Moscow (RU); Mikhail Evgenievich Givargizov, Moscow (RU); Vladimir Iliich Ershov, Moscow (RU); Nina Ivanovna Manshina, Fryazino (RU)

(73) Assignee: Crystals and Technologies, Ltd., Moscow (RU)

( * ) Notice: Subject to any disclaimer, the term of this patent is extended or adjusted under 35 U.S.C. 154(b) by 0 days.

(21) Appl. No.: 09/674,415

(22) PCT Filed: Apr. 30, 1999

(86) PCT No.: PCT/RU99/00149

§ 371 (c)(1),
(2), (4) Date: Feb. 5, 2001

(87) PCT Pub. No.: WO99/57743

PCT Pub. Date: Nov. 11, 1999

(30) Foreign Application Priority Data

Apr. 30, 1998 (RU) ..... 98109078
Jan. 18, 1999 (RU) ..... 99101033

(51) Int. Cl.[7] ..... H01J 19/06

(52) U.S. Cl. ..... 313/346 R; 313/326; 313/336; 313/351; 438/300

(58) Field of Search ..... 313/309, 310, 313/311, 326, 336, 346 R, 351, 352, 354, 355, 357; 438/142, 197, 299, 300

(56) References Cited

U.S. PATENT DOCUMENTS 3,772,556 A * 11/1973 Williams ..... 313/309
4,940,916 A * 7/1990 Borel et al. ..... 313/309
5,090,932 A 2/1992 Dieumegard et al. ..... 455/24
5,151,061 A * 9/1992 Sandhu ..... 313/309
5,188,977 A 2/1993 Stengl et al. ..... 438/20
5,214,347 A * 5/1993 Gray ..... 313/309
5,710,478 A 1/1998 Kanemaru et al. ..... 313/336
5,717,278 A 2/1998 Bartha et al. ..... 313/336
5,780,318 A * 7/1998 Hirano et al. ..... 313/309
5,791,959 A 8/1998 Bartha et al. ..... 455/24
5,817,201 A 10/1998 Greschner et al. ..... 156/150
5,825,122 A 10/1998 Givargizov et al. ..... 313/336
5,851,669 A * 12/1998 Macaulay et al. ..... 313/309
5,973,444 A * 10/1999 Xu et al. ..... 313/309
6,020,677 A * 2/2000 Blanchet-Fincher et al. ..... 313/309
6,097,138 A * 8/2000 Nakamoto ..... 313/309
6,121,721 A * 9/2000 Alwan ..... 313/309
6,333,598 B1 * 12/2001 Hsu et al. ..... 313/309

OTHER PUBLICATIONS

Curtin, Christopher; Vaccum Fluorescent, Electroluminescent, Field Emission, and Other Emissive Displays, Dec. 1994, WTEC Hyper–Librarian (http://www.itri.loyola.edu/displays/ section 4).*

(List continued on next page.)

*Primary Examiner*—Thomas M. Sember
*Assistant Examiner*—Ismael Negron
(74) *Attorney, Agent, or Firm*—Knobbe Martens Olson & Bear LLP

(57) ABSTRACT

An electron source is proposed where a field emitter is formed by a whisker grown epitaxially on a substrate. A ballast resistor and an active area are placed in the body and/or on the surface of the field matter. The ballast resister can be realized as a barrier in the shape of n–n+, p–p+, p–n semiconductor junctions or insulation layer that crosses the charge carrier flow. Components for controlling such electron sources are arranged vertically. This allows to decrease significantly the area taken by the components, and, in such a way, to increase the resolving power of devices and expand fields of their applications. In so doing, owing to whisker-grown field emitters it is possible to control the emission currents by low voltages at strong electric fields.

38 Claims, 9 Drawing Sheets

Corrigan, McCauley, Zhou, Krauss, Auciello, Gruen, Temple, McGuire, and Chang; Electron Emission Properties of Silicon Field Emitter Arrays Coated With Nanocrystalline Diamond From Fullerene Precursors, Dec. 1997, MRSS Proceedings, vol. 498.*

Sang Jik Kwon and Young Hwa Shin; Field Emission Properties of the Polycrystaline Diamond Film Prepared by Microwave–Assisted Plasma Chemical Vapor Deposition;□□Mar. 1998, J. Vac. Sci. Tech. B 16 (2) pag. 712–715.*

Gunthër, Göhl, Müller, Givargizov, Zadorozhanaya, Stepanova,Spitsyn, Blaut–Bachev, Seleznev and Suetin; Abstract: Comparison of Field Emission from Diamond and AIN Coated Si Tips; Sep. 2000, Europe FE 2000, Segovia Spain.*

Hajra, Hunt, Ding, Auciello, Carlisle and Gruen; Effect of Gases on the Field Emission Properties of UNCD Coated Silicon Field Emitter Arrays; Jul. 2002, IVMC/IFES Conference, Lyon, France (http://ivmc2002.univ–lyon1.fr/Abstracts/EA_097.pdf).*

* cited by examiner

STABILIZED AND CONTROLLED ELECTRON SOURCES, MATRIX SYSTEMS OF THE ELECTRON SOURCES, AND METHOD FOR PRODUCTION THEREOF

BACKGROUND OF THE INVENTION

1. Field of the Invention

This invention relates to microelectronics, including vacuum microelectronics, in particular to filed emission devices, specifically to filed emission cathodes, as well as to other field emission devices such as field emission displays, electron sources for electron guns, for microwave devices, etc.

2. Description of the Related Technology

During the last few years, various versions for realization of field emission, including the emission with using of defects in planar structures, have been considered, the defects acting as initiators of the field emission [1,2]. Field emitters such as tips and blades prepared by special methods, as field emission initiators, have many advantages in comparison with the defects from the point of view of feasibility to realize regular multiple arrays of the field emitters and controlled growing of the arrays on large areas. However, cases often occur at the practice when the regular arrays are inferior to structures with an incidental distribution of the defects in homogeneity.

Troubles in stability and controllability of electron flows given off by the field emitters are also known. Troubles with uniformity of the field electron emission of the multiple field emitter arrays are of the same nature. The uniformity is typically ensured by ballast resistors that equalize electron currents through different field emitters of the multiple field emitter arrays.

Various design and technological solutions are used for overcoming of the troubles (problems) with the field emitter.

A controlled electron source is known where the field emitter is connected to the drain of MOSFET that serves as a stable current electron source [3,4]. In such an electron source, the issue of stability and controllability of the field emission current is successfully solved. However, transistor p–n junctions in the electron source are placed in the substrate where the field emitter is placed, too, and a substrate, too. This increases significantly the area taken by a pixel and, accordingly, decreases the resolving power of field emission displays based on such electron sources.

A solution of the problems of stability and controllability combined with the spatial arrangement of the control components is successfully realized in the patent [5]. FIG. 1 illustrates the field emission cathode according to the prior art [5]. In FIG. 1, reference numerals 1–4 represent a substrate, a cathode, a diode, and a metallic layer, respectively. Also, reference numerals 5–8 represent a semiconductor layer, an emitter, an insulating layer, and a control electrode, respectively. Here, in the electron source the diode (3) is placed in the emitter base for the stability and the controllability of the field emission current. Such a design decreases principally the sizes of the electron source three time, as minimum, because its control component takes the same place as the field emitter itself. Such an electron source allows to regulate the voltage so that the starting voltage for the field emission is decreased and, in such a way, the uniform emission is ensured. A plurality of emitters, acting through diodes and operating actually as ballast resistors, are placed onto the cathode electrode. Such a design ensures the uniformity of the field emission and, simultaneously, its controllability. However, the proposed in [5] components of stabilization and control of the field emission current are insufficient for successful solving of the problems of uniformity and controllability.

In the patent [6] a more complete using of the advantages of the field emitters is realized. The field emitter is considered as a spatially distributed object (various parts of which serve as functional components of a device) rather than as a "material point" of the field emission, without spatial characteristics of their various parts.

According to the patent [6] components for control of the electron source are transformed from the planar arrangements, as it was done in [3,4], into a vertical arrangement. FIGS. 2*a* and 2*b* illustrate the field emission devices according to the prior art [3]. Thus, a principal role in the stabilization and control of the field emission current is assigned (allocated), to the body and to the surface of the field emitter, in addition to the usual role of its top.

FIGS. 3*a* and 3*b* illustrate the field emission devices according, to the prior art [6]. In FIGS. 3*a* and 3*b*, reference numeral 01 represents a top of field emitter. Reference numeral 02 represents a control electrode. Reference numerals 03 and 03*a* represent an insulator. Reference numerals 04 and 06 represent a barrier (junction). Reference numeral 08 represents a control electrode. Reference numerals 09 and 09*i* represent a conductive part of substrate and an insulator part of substrate, respectively.

FIG. 3*c* illustrates the field emitter with various function areas of the prior art. In FIG. 3*c*, reference character E represents an external electric field. Reference character $E_j$ represents various positions of a junction boundary (for example, p–n junction) under the influence of external electric fields of various values. Reference character $E_t$ represents the position of the junction boundary when electrons start to flow through the junction Reference characters l and d represent the length of the active area and width of the active area, respectively.

FIG. 3*d* illustrates the method for preparation of the field emitter according to [6]. Reference numerals 12, 13, and 14 represent layers with different kinds of conductivity. In FIGS. 3*a*–3*d*, reference characters a, b and c (i.e., not associated with any reference numeral) represent areas of various kinds of conductivity. Reference character e represent position of active areas. Similar to [3–5] in the patent [6] an extracting electrode acts to electrons placed in the emitter top. In [6] electron sources are considered where the field emitters have sufficient length and thickness. Therefore, from the point of the action of the control electrodes or barriers (such as the diode in [5]), as minimum four areas of the electron sources are considered:—the substrate on which the field emitter is placed;—basis of the field emitters;—top of the field emitters;—their bodies. These are areas of selective activation, or active areas. So, the active area is an area in the substrate, in body of the field emitter, in its basis or at its top. A connection of the source of the charge carriers with the field emitter is implemented through the areas, and a control of the field emission current (of the charge carriers flow) from one area to another by means of stimulation and extracting is implemented.

In some cases, however, such a control of the charge carrier flow can not be realized in [6]. This is related to the fact that the field emitter, being under the action of a rather high electric field, for example, of the anode one, is subjected to its influence not only to the area of the top of field emitter but also all over the body. As a result, such an electric field, acting to the field emitter, "shorts out" an action various barriers and over control components. The method for preparation of the field emitters by "wet" or "dry" etching used in the patent [6] results in formation of the emitters having small ratios of the length l of the active area to its diameter d. In this case, for controlling of the field emission current, a very large voltage must be used in order to compensate the action of the large external (for example, of anode) electric field.

Indeed, if the field emitter, containing a part with the p-type conductivity is placed in the electric field E (FIG. 3*c*), formed by the anode, the boundary of the first of the first p–n junction 04 is shifted $E_j$ to the p-area. At a certain value $E_t$, the first junction 04 approaches to the second one 06 in such an extent that the electrons from the n-area c begin tunneling through the narrowed barrier to the field emitter. This causes emission of electrons from field emitter. This is the "shorting out" under the external electric field. Existence of the control electrode near the field emitter both in traditional (FIG. 3*a*) and in the considered [6] version (FIG. 3*b*) can compensate the action of the penetrating electric field and, such a manner, to "lock" the charge carriers of the second n-area c. However, it is known that, at the geometric sizes, considered in [6], the length l of the p-area is compatible with or and even shorter than the width d. As it is known, for "locking" of the charge carriers value of the traverse electric field of the control electrode 02 or 08 must be comparable with the longitudinal field responsible for the charge carrier flow. This makes it necessary to apply large voltages to the control electrodes.

In addition, in the patent [6] the control electrodes stimulate the flowing of the charge carriers through the active area and extract the electrons from the field emitter. In such a way, the electron emission is stabilized and controlled. At the same time the control electrodes in [6] does not lock the flow of the charge carriers through the active area. The above function of the control electrodes-to stimulate the flowing of the charge carriers, makes it necessary mentioned in [6] approximate sizes of p-area as" . . . formed to no more than several microns in thickness and generally to submicron order thickness" (see column 8, last paragraph in [6]). This means that the authors of [6] did not consider a possibility to provide the control electrode by "locking" function and, as a result, they considered the design which is enough just for stimulation and which; is not enough for locking the electrons moves under the influence of strong external electric field. However, it is known that if the control electrodes can lock the flow, it is possible to use small (in absolute value) negative voltage for the locking of the flow. This approach is very important from practical point of view-to use low voltage "electric keys" in different driving systems, for example, in the field emission displays. Such a version can not be realized in [6] due to small value of the characteristic l/d that is there approximately equal to 1 which is provided by the design proposed in [6].

SUMMARY OF THE INVENTION

An electron source is proposed, the source including a field emitter, a substrate, a source of charge carriers, and at least one ballast resistor. The field emitter is implemented of a whisker epitaxially grown on the substrate, and at least one ballast resistor is implemented as a barrier which is represented as a boundary in the body of the field emitter. The boundary is formed by a contact of materials with different kinds of conductivity.

In the electron source the field emitter is implemented of at least one semiconductor material. At least one barrier in the electron source is formed by junction of materials with different kinds of conductivity, such as n, n+, p, p+ kinds. At least one barrier is formed by an insulating layer that is across to direction of charge carriers flow.

The field emitter is formed by a tip, the tip consisting of two coaxial parts, a broad lower part and a narrower upper part. The field emitter can be also formed by a blade. The tops of the field emitter are sharpened and coated by diamond or diamond-like material, and the coatings can be sharpened, too.

At another version of the electron source the barrier is formed by a boundary between a body of the field emitter and a conducting layer placed on a surface of the field emitter. In the electron source, at least one ballast resistor is implemented as a barrier which is represented as a boundary in the field emitter body, the boundary being formed by contacts of the materials with different kinds of conductivity.

The field emitter is implemented of at least one semiconductor material, and the conducting layer is also implemented of at least one semiconductor material.

At least one barrier in the field emitter is formed by junction of materials with different kinds of conductivity, such as n, n+, p, p+ kinds.

In another version of the electron source at least one barrier is formed by an insulating layer that is across to the direction of charge carriers flow.

The field emitter can be formed either by a tip or by a blade. In the case of the tip shape the field emitter consists of two coaxial parts, a broad lower part and a narrower upper part The top of the field emitter is sharpened and coated by diamond or diamond-like material, the coating being sharpened, too. The diamond-like material consists of carbon atoms having a non-diamond structure, i.e., this relates to a crystal type. The diamond-like materials differ from a diamond in sp2 and sp3 orbital portions of chemical bondings. This term has been used worldwide for at least the past 10–20 years.

The source of the charge carriers is connected to the field emitter via substrate and/or a conducting layer placed on a surface of the field emitter directly or via an insulating layer.

In one more version of the electron source the substrate has a shape of a tip and is formed by an insulator and by a conductive layer, the ballast resistor being implemented by the layer.

The conductive layer in the electron source contains at least one barrier for charge carriers. At least one barrier in the electron source is formed by junction of materials with different kinds of conductivity, such as n, n+, p, p+ kinds, and at least one barrier is formed by insulating layer that is across to direction of charge carriers flow.

In one more version the electron source can be controlled containing at least one control electrode. The electron source can contain at least one active area in the body and/or on the surface of the field emitter. The active area can be realized in conducting layer placed on the surface of the substrate and/or of the field emitter directly or via an insulator layer.

At least one control electrode is placed close to one barrier for the charge carriers or on side surface of the field emitter via an insulator layer. The control electrode is separated from the field emitter by a vacuum gap or placed along the field emitter. The control electrode can have a direct contact with the side surface of the field emitter.

The substrate in the controlled electron source can be crystalline, or can be implemented by an insulator and a conductive layer placed on the insulator. The substrate can be implemented of the single-crystalline material with orientation (111).

The surface of the substrate can be coated by a material which is transparent for electrons and which prevents outlet of chemical elements from the surface of the controlled electron source, the material being diamond or diamond-like carbon.

The invention also considers a matrix of the controlled electron sources containing at least two controlled electron sources. The matrix can contain a two-dimensional system of mutually perpendicular rows of the controlled electron sources, at least one of the control electrode of the electron sources having a diaphragm shape and being implemented of diamond or diamond-like material.

The substrate on which the controlled electron source is arranged is implemented of conductive material placed on an insulator.

The matrix contains conductive buses which form two systems where buses of each of the systems are mutually parallel whereas the buses of two different systems are mutually perpendicular, the two systems being placed in two levels and separated by an insulating layer.

This invention proposes also a method for preparation of controlled electron sources including a formation on a solid substrate of field emitters each of that contains at least one transverse junction formed by materials having different electrical conductivity, a formation of at least one controlled electrode close to such junctions, where the field emitters are implemented of whiskers epitaxially grown by the vapor-liquid-solid mechanism. The implementation of the field emitters can include formation of the hollows in the substrate and deposition of solvent particles at the bottom of the hollows. The implementation of the field emitters can also include placing of solvent particles on the substrate and etching of the substrate around the particles.

As mentioned above, the method can include further procedure for formation of the field emitters, that is to say, placing of a source material, having a first kind of conductivity, opposite to the substrate with the solvent particles on it, growing of whiskers having the first kind of conductivity, stabilized cooling of the grown whiskers, having the globules on its tops, with an introduction of an inert gas into atmosphere, with simultaneous decreasing of the temperature of the substrate, changing of the source material for another source having a second kind of conductivity, stabilized heating of the grown whiskers, having the globules on its tops, with an introduction of an inert gas into atmosphere, with simultaneous increasing of the temperature of the substrate, and growing of whiskers having the second kind of conductivity. The method also includes possibility to change the source materials more than two times.

As mentioned above, the method can also include further procedure for formation of the field emitters includes growing of whiskers in a gaseous atmosphere containing the element or elements of which the substrate consists, introduction of doping gaseous compounds into the gas atmosphere. According to the method the formation of the field emitters can includes more than one procedure of introduction into the gas atmosphere of different gaseous doping compounds.

Figure 1:
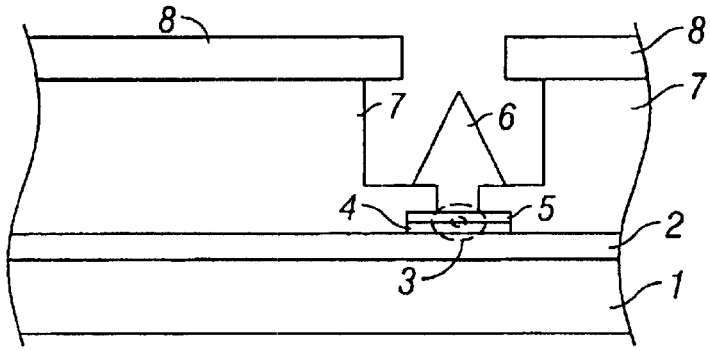
FIG. 1 (Prior Art)
FIG. 1 illustrates the field emission cathode according to the prior art [5].
Figure 2A:
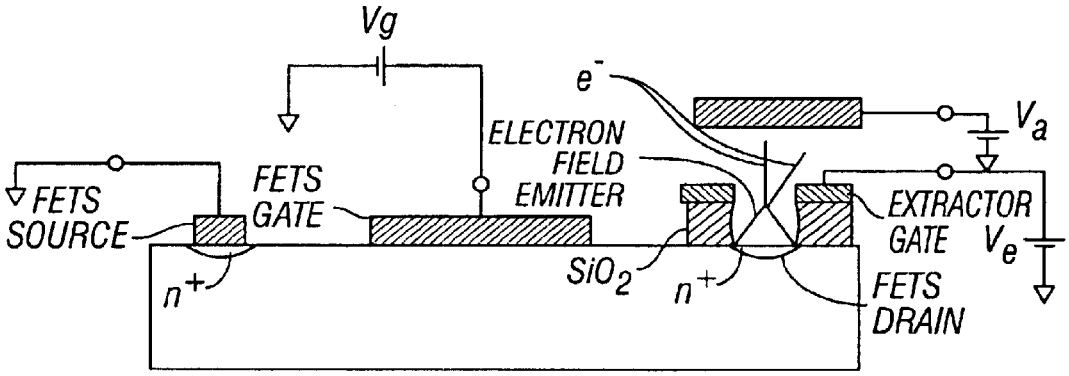
FIG. 2A (Prior Art)
FIGS. 2*a*, 2*b* illustrate the field emission devices according to the prior art [3].
Figure 2B:
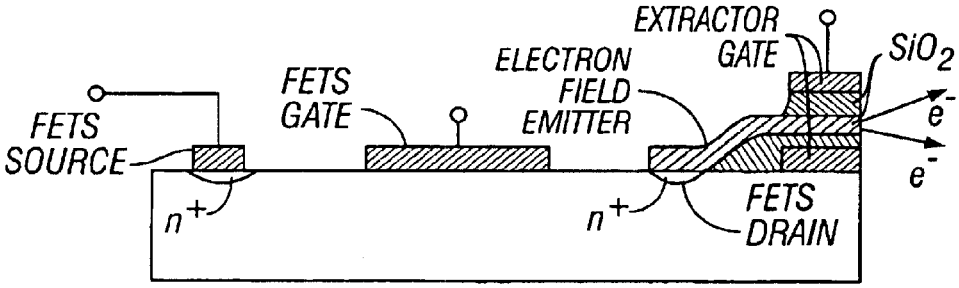
FIG. 2B (Prior Art)
Figure 3A:
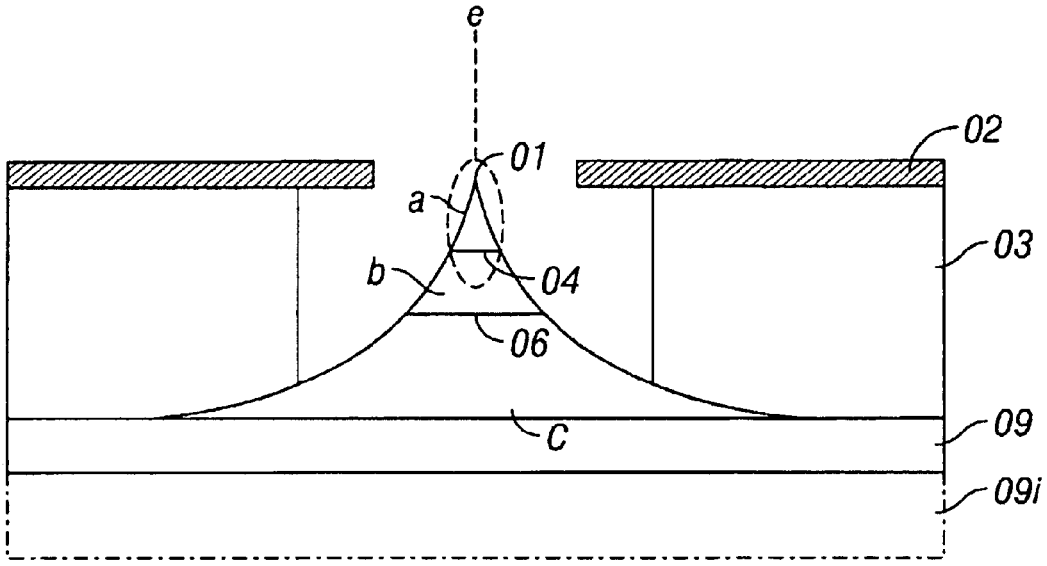
FIG. 3A (Prior Art)
FIGS. 3*a*, 3*b* illustrate the field emission devices according to the prior art [6].
Figure 3B:
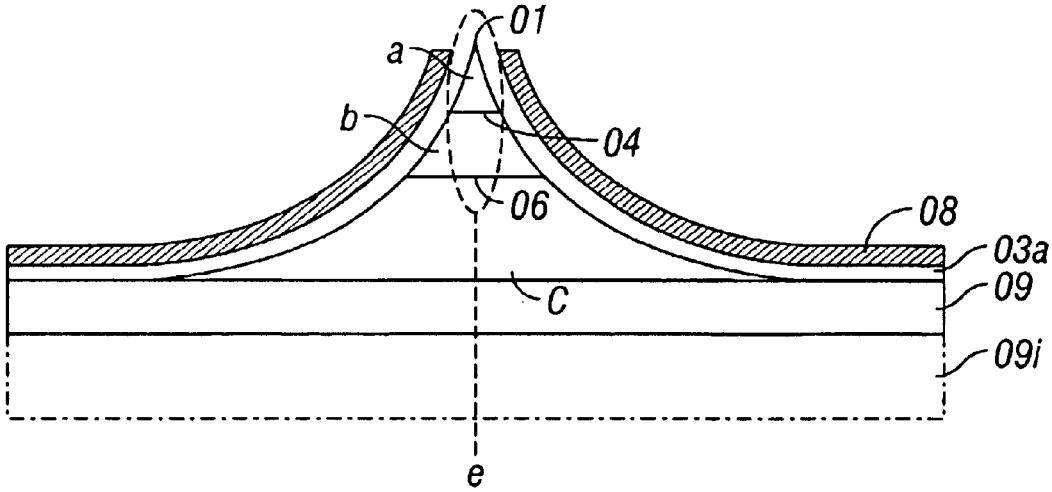
FIG. 3B (Prior Art)
Figure 3C:
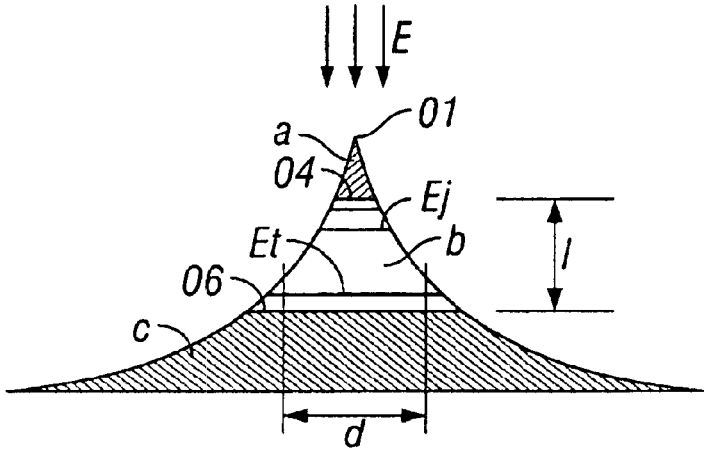
FIG. 3C (Prior Art)
FIG. 3*c* illustrates the field emitter with various function areas of the prior art.
Figure 3D:
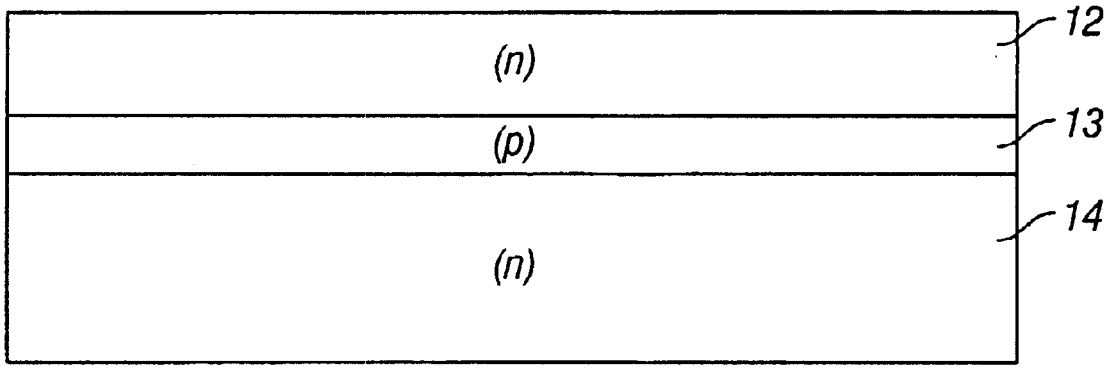
FIG. 3D (Prior Art)
FIG. 3*d* illustrates the method for preparation of the field emitter according to [6].

DETAILED DESCRIPTION OF THE INVENTION.

In this invention, the drawback is overcome owing to the fact that. Here, for stabilization and controlling of the field emission, a whisker ("filament crystal") characterized by l/d >> 1 is used. Here as discussed above, reference characters l and d represent length of the active area and width of the active area, respectively. A method for preparation of the whiskers with traverse p–n junctions is also proposed in this invention. As a result, the design proposed allows to control the field emission by locking the charge carrier flow.

The approach proposed is especially important at creation of effective long-living flat panel displays. Indeed, the higher the anode (accelerating) electric field, the more effective and long-living are their phosphors because, the efficiency is larger at higher voltages. Also at the increasing of anode voltage in such devices and, accordingly, decreasing of the current the durability of the phosphors is increased. The high accelerating voltage allows to use a protecting coating layer (for example, aluminum) that prevents the decomposition of the phosphors and increases the illumination owing to the light reflection. In addition, the decreasing currents are useful for the field emitters themselves (especially of semiconductor emitters) because at high currents the emitters are heated resulting in their degradation.

Figure 4A:
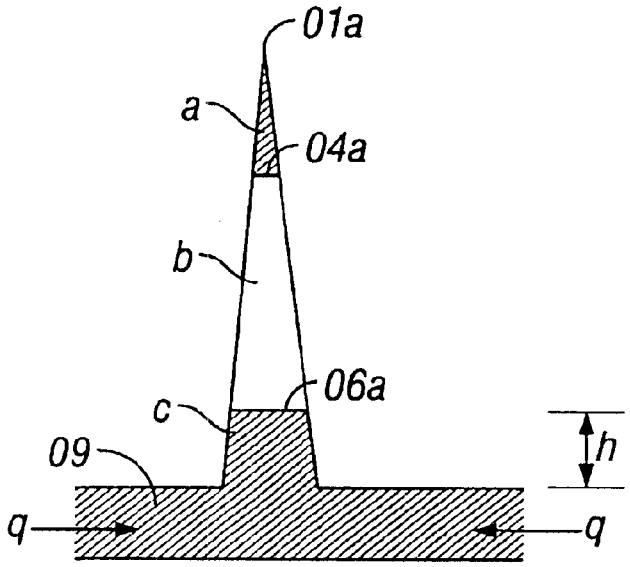
FIGS. 4*a*, 4*b*, 4*c*, 4*d*, 4*e* illustrate the stabilized electron sources according to the present invention.
Figure 4B:
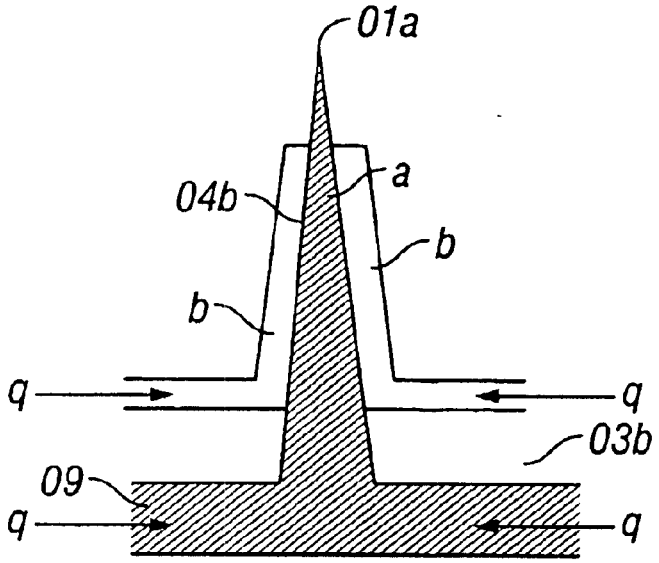
Figure 4C:
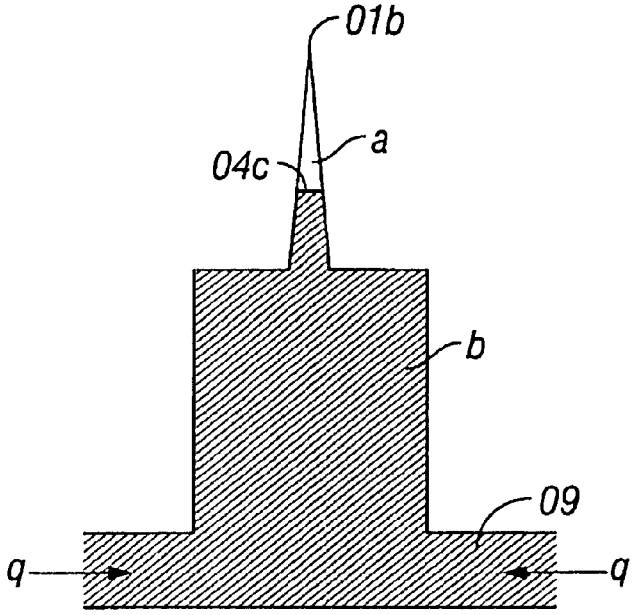

In this invention various possibilities for the stabilization and control of the field emission current based on using of epitaxially grown whiskers are proposed. By whisker growing, the ratio l/d can implemented as 5–10 and more times. In addition, with the whisker grown field emitters broad possibility for shape variation and creation of the control electrodes can be realized. In particular, a design with step-shaped emitter is proposed in FIG. 4*c*.

According to this invention, the field emitter is implemented of whisker that includes at least one barrier (for example, n, n+, p, p+ or p–n junction), i.e., the barrier is placed in the body of the field emitter, being at some height h >0 (FIG. 4*a*) above the substrate, i.e., above its own basis. At the same time in the patents [3,5] one of the barrier is placed at the basis of the field emitter being either at the upper level of the substrate or below it.

As it was mentioned above the active area can be placed both in the basis of field emitter [5], top [3,5] or substrate [3], and in the body of the field emitter [6]. In this invention a version is proposed when the active area is placed on side surface of the field emitter or in the body of the material that has direct or indirect contact with substrate or field emitter.

The active area can be placed also in thin surface conductive layer arranged on an insulating substrate. Thus, the version of the controlling electron source as purposed in this invention not only has solved the problem of transferring the stabilizing and controlling components from their planar arrangement to vertical one (and, in such a way, of increasing the resolution of the device) but also allows to conserve the controllability of the emission current by means of low voltage. In such a way, this allows to realize said controllability both in the case of low and high external electric field.

In the patent [6], as it was mentioned above, the method for fabrication of the field emitters with traverse p–n junctions. However, this method does not allow to obtain optimal geometric parameters of the field emitter that gives necessary functional characteristics.

The methods for growing oriented whiskers arrays are known [7,8,9,10]. The methods, however, do not contain procedures for preparation of the junction, for example, like p–n junctions. In this invention, such procedures are proposed.

FIGS. 4*a*–4*e* illustrate the stabilized electron sources according to the present invention. In FIGS. 4*a*–4*e*, reference numerals 01*a*, 01*b*, and 01*c* represent a top of the field emitter. Reference numeral 03*b* represents an insulator if charge carriers are provided via the surface layer. Also, the insulator (03) can be a conductive material if charge carriers are provided via the substrate.

Reference numerals 04*a*–04*e*, and 06*a*–06*c* represent a barrier (for example, p–n junction). Reference numeral 09 represents a conductive part of the substrate. Reference numeral 09*i* represents an insulator part of the substrate. In FIGS. 4*a*–4*e*, reference characters a, b, c (i.e., not associated with any reference numeral) represent areas of various types of conductivity. Reference character q represents the possible movement of charge carriers. Reference character h represents the height of the position of the barrier above the substrate.

Throughout the specification, the term "epitaxially grown" means 1) the tip has the same crystalline structure as the substrate, and 2) the tip has a "extended" form, so the relation of the length to its diameter significantly greater than 1 as reflected in the formula l/d>>1 and shown in FIGS. 4–6.

EXAMPLE 1

Figure 4D:
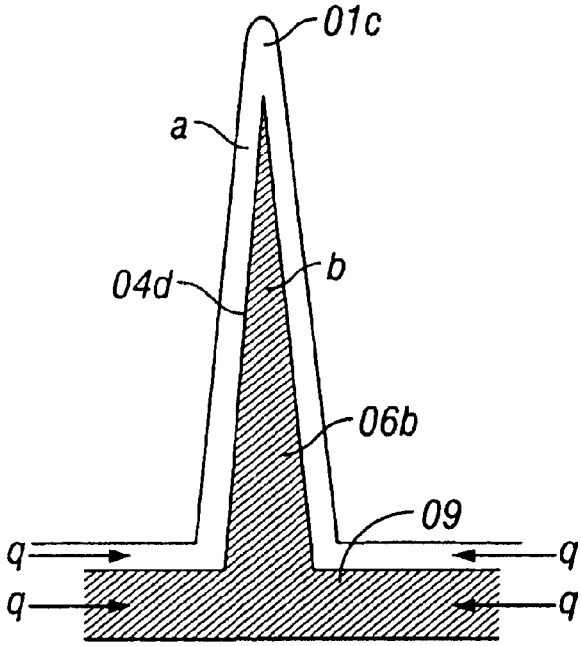
Figure 4E:
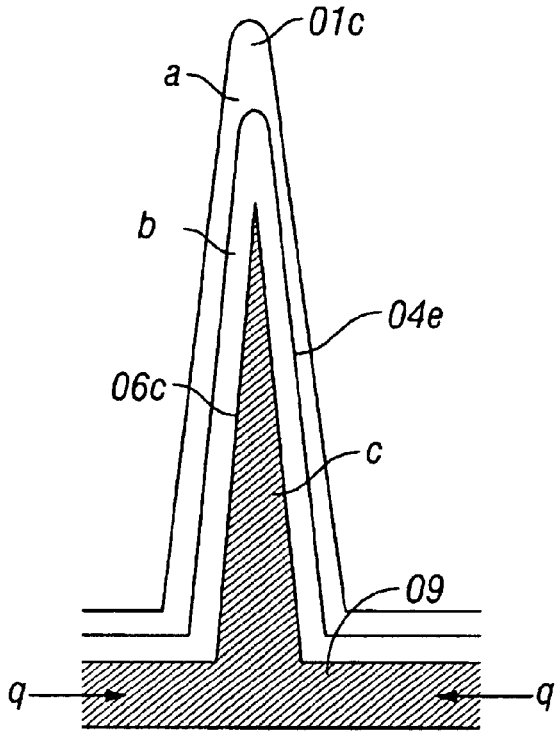

A most typical version for realization of the stabilized electron sources that uses a barrier as a ballast resistor is the following. A thin layer of n-type silicon is deposited onto p-type silicon tip that epitaxial to substrate (FIG. 4*d*). The junction between the p-type of silicon and then-type silicon coating acts as a ballast resistor. FIGS. 5*a*–5*d* illustrate the controlled electron sources according to the present invention. In FIGS. 5*a*–5*d*, reference numeral 01*d* represents a top of the field emitter. Reference numerals 03*c* and 03*d* represent an insulator if charge carriers are provided via the surface layer. The insulators (03*c* and 03*d*) can be a conductive material if charge carriers are provided via the substrate.

Reference numerals 04*f*, 04*g*, 06*c* represent a barrier (for example, p–n junction). Reference numeral 08 represents a control electrode. Reference numeral 09 represents a conductive part of the substrate. In FIGS. 5*a*–5*d*, reference characters a, b, c (i.e., not associated with any reference numeral) represent areas of various types of conductivity. Reference character e represents position of active areas.

EXAMPLE 2

Figure 5A:
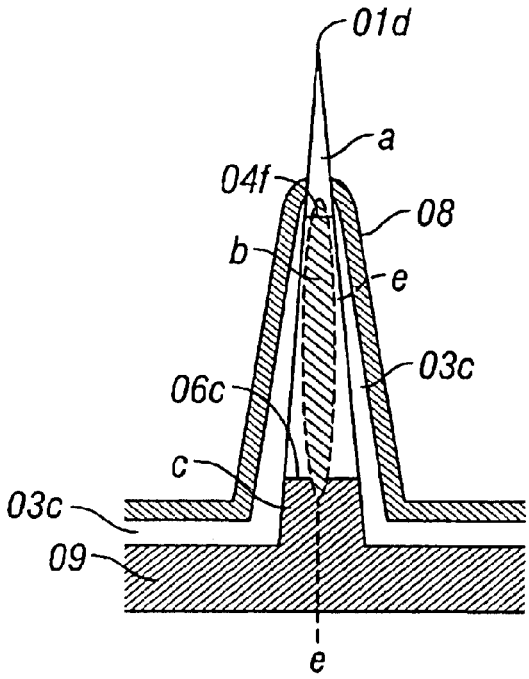
FIGS. 5*a*, 5*b*, 5*c*, 5*d* illustrate the controlled electron sources according to the present invention.
Figure 5B:
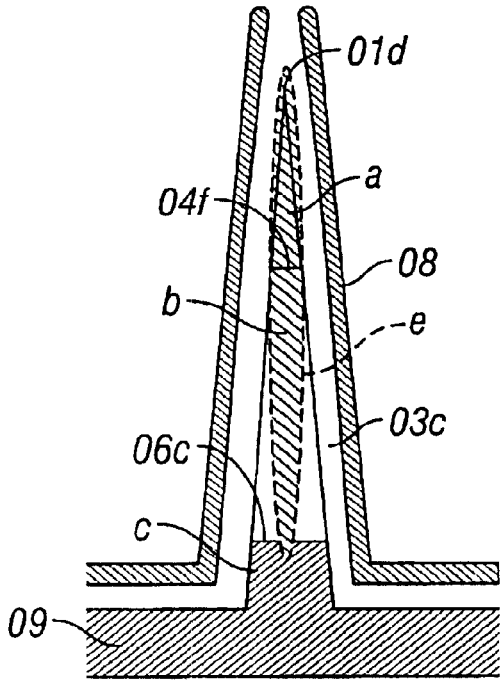
Figure 5C:
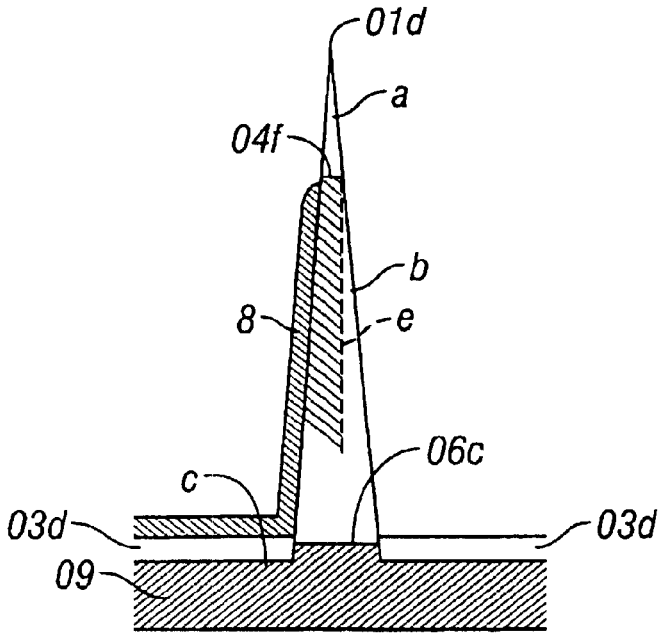
Figure 5D:
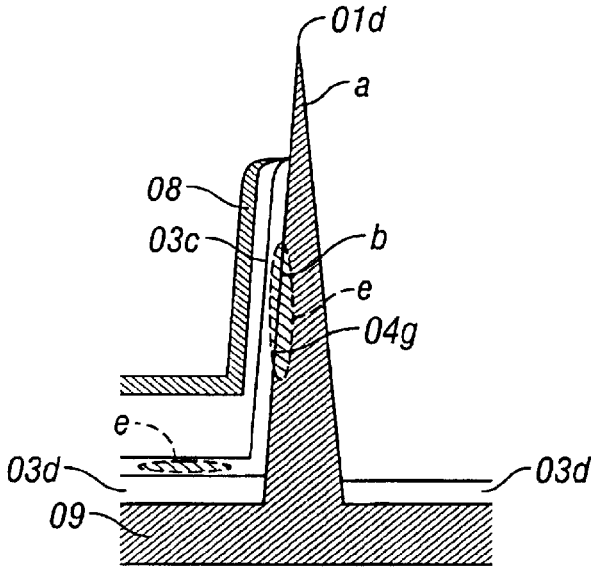
Figure 6A:
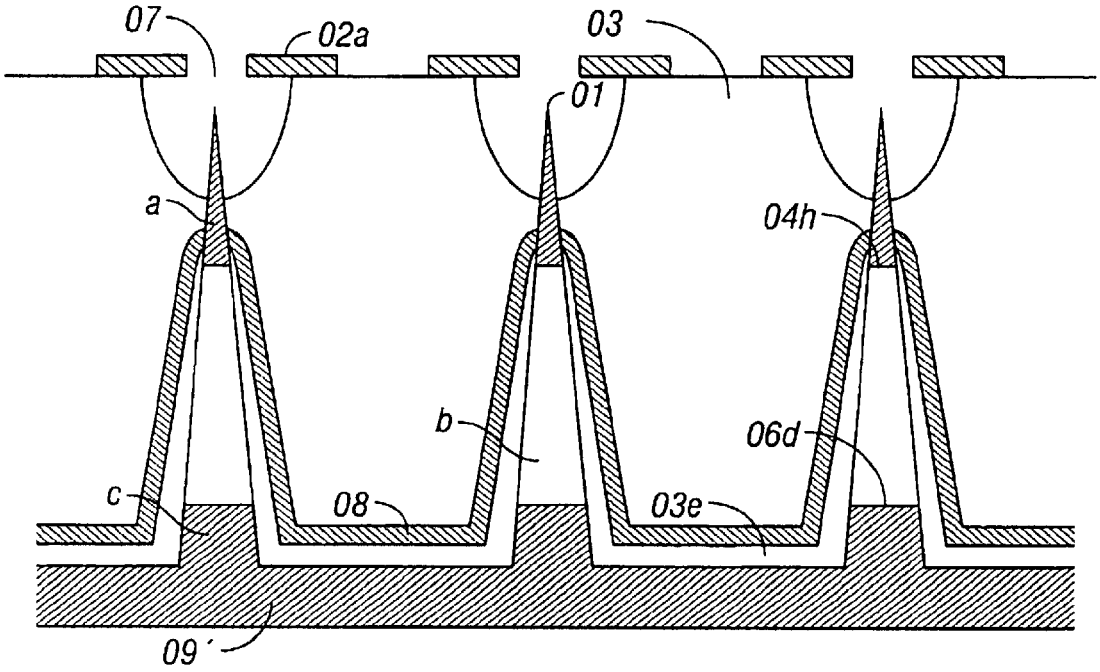
FIGS. 6*a* and 6*b* illustrate the matrix system of the controlled electron sources according to the present invention.
Figure 6B:
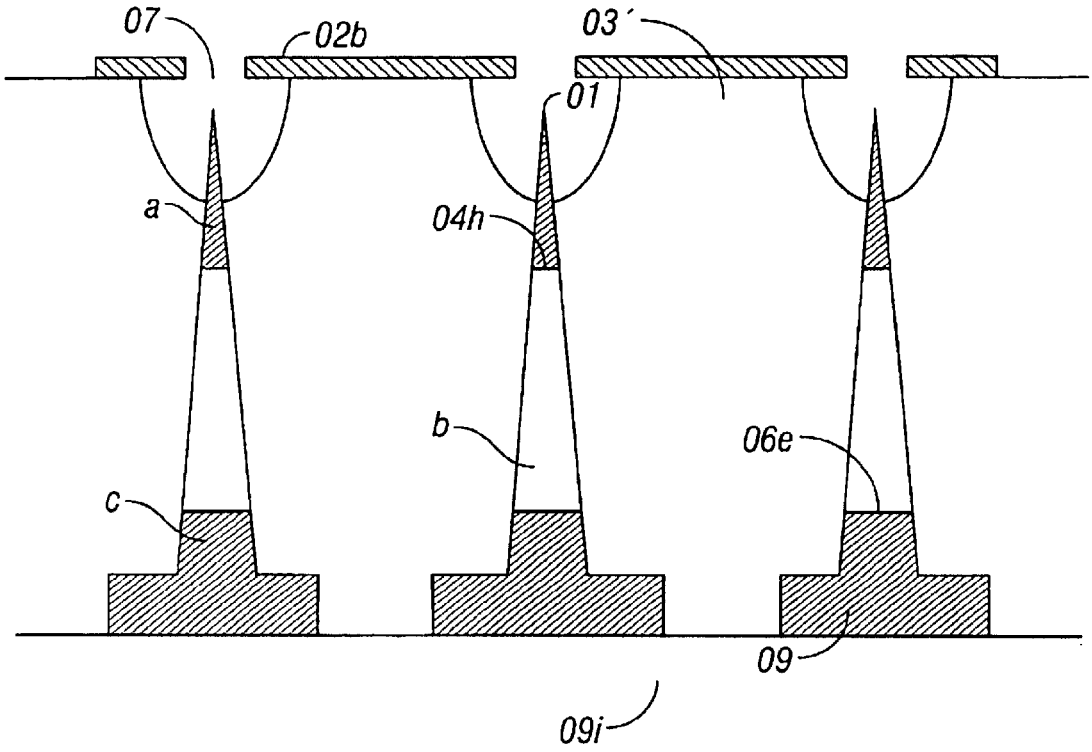

A most typical version for realization of the controlled electron sources that uses a vertical arrangement of the control components is the following. The tip contains in its body two p–n junctions. An upper part of the tip is implemented of n-type material. A lower part of the tip as well as the adjacent substrate are implemented of n-type material. A control electrode is placed at a middle part of the tip which is implemented of p-type material. The control electrode has an extended length, is placed on the surface of the tip and has with it a direct contact (FIG. 5*c*). When a voltage VOPD is applied to the control electrode, an inverse layer is induced at the area b along the surface of the field emitter, and electrons from the area c begin to penetrate into area a through the inverse layer. Then the electrons are emitting from the field emitters under the action of the anode voltage. FIGS. 6*a* and 6*b* illustrate the matrix system of the controlled electron sources according to the present invention. In FIGS. 6*a* and 6*b*, reference numeral 01 represents a top of the field emitter. Reference numerals 02*a* and 02*b* represent a control electrode. Reference numeral 03*e* represents an insulator if charge carriers are provided via the surface layer. The insulator (03*e*) can be conductive material if charge carriers are provided via the substrate. Reference numeral 03' represents an insulating glass layer.

Reference numerals 04*h*, 06*d*, 06*e* represent a barrier (for example, p–n junction). Reference numeral 07 represents a centrosymmetrical cavity. Reference numeral 08 represents a control electrode. Reference numeral 09 represents a conductive part of the substrate. Reference numeral 09*i* represents an insulator part of the substrate. In FIGS. 6*a* and 6*b*, reference characters a, b, c (i.e., not associated with any reference numeral) represent areas of various types of conductivity. Reference numeral 09' represents a conducting substrate of silicon having the crystallographic orientation (111).

In FIG. 6*a*, rows of control electrodes 02*a*, 02*b*, and 08 are mutually perpendicular, and together perform the controlling of the emission of the matrix system. In FIG. 6*b*, rows of control electrodes 02*a*, 02*b*, and rows of the conductive part 09 of substrate based on the insulator part 09*i* of the substrate are mutually perpendicular, and together perform the controlling of the emission of the matrix system.

Figure 7:
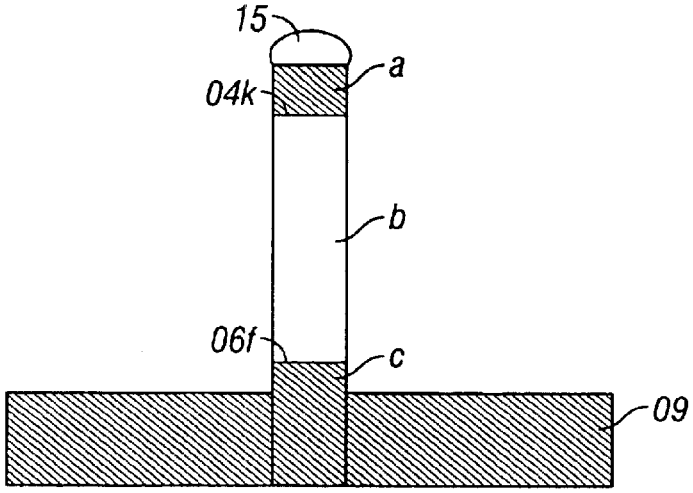
FIG. 7 illustrates grown silicon whisker with transversal barriers (junctions).

FIG. 7 illustrates grown silicon whisker with transversal barriers (junctions). In FIG. 7, reference numerals 04*k* and 06*f* represent a barrier (for example, p–n junction). Reference numeral 15 represents a solidified globule consisting of crystallites of silicon and solvent. Reference numeral 09 represents a conductive part of substrate. In FIG. 7, reference characters a, b, c (i.e., not associated with any reference numeral) represent areas of various types of conductivity. By processing the whisker with a chemical etch of silicon, the whisker is transformed into a tip with simultaneous removal of the globule (15).

EXAMPLE 3

A most typical version for realization of the matrix system of the controlled electron sources that uses the vertical arrangement of the control components is the following.

Rows of sharpened whisker-grown field emitters 01 are formed on a conducting substrate 09' of silicon having the crystallographic orientation (111) as shown in FIG. 6*a*. A system of parallel rows of control electrodes 08 is formed on the surface of the field emitters 01, the insulating layers 03 being placed between the field emitters 01 and the control electrodes 08. Then, an insulating glass layer 03' is deposited on the structure. After that, a set of parallel electrodes 02*a* and 02*b* are deposited onto the glass layer 03', and centrosymmetrical cavities 07 are formed at the places corresponding to the emitters so that the upper ("top") of each of the emitters 01 are in the centers of the cavities 07 being risen above their bottoms. It is important that the set of the electrodes 02*a* and 02*b* is perpendicular to the system of parallel rows of the control electrode 08. In order to obtain an emission from a given field emitter, it is necessary to apply a voltage Vopen to a row in the system of the control electrodes 08 and, simultaneously, to apply a voltage Vext, to the set of electrodes 02*a* and 02*b*. At the cross of the row and of the electrodes 02*a* and 02*b*, the sum voltage Vopen+ Vext, initiates the emission.

REFERENCES

1. I. Brodie, P. R. Schwoebel, Vacuum Microelectronic Devices, Proceedings of the IEEE. Vol. 82, No. 7, July 1994
2. W. Zhu, G. P. Kochanski, S. Jin and L. Siebles, J. Appl. Phys. 78 (1995) 2707
3. H. F. Gray, Regulatable field emitter device and method of production thereof U.S. Pat. No. 5,359,256, CI 313/169 (1994).
4. Junji Itoh, Takayuki Hirano, and Seigo Kanemaru, Ultrastable emission from a metaloxide-semiconductor field-effect transistor-structured Si emitter tip, Appl. Phys. Lett. 69 (11), 9 Sep. 1996, p. 1577
5. Yoichi Kobori, Mitsuru Tanaka, Field emission cathode, U.S. Pat. No. 5,162,704, CI 315/349 (1992).
6. Seigo Kanemaru, Junji Itoh, Field emitter having source, channel, and drain layers, U.S. Pat. No. 5,710, 478, Date of patent 20 Jan. 1998
7. E. I. Givargizov, Method and apparatus for growing oriented whisker arrays, RU Patent 2,099,808, 20 Dec. 1997r.
8. Yoshinori Terui Ryuichi Terasaki, Method for producing single crystal, and needle-like single crystal, U.S. Pat. No. 5,544,617 Date of patent 13 Aug. 1996
9. Didier Pribat et al, Method for the controlled growth of crystal whiskers and application thereof to the making of tip microcathodes.
10. Michio Okajima et al, Fabrication method of fine structures, U.S. Pat. No. 5,381,753 Date of patent 17 Jan. 1995

What is claimed is:

1. An electron source comprising:

a substrate;

a field emitter, a body of the field emitter being a whisker epitaxially grown on the substrate;

a source of charge carriers supplying the field emitter; and at least one ballast resistor configured as a barrier between different materials located in or proximate to the field emitter.

2. The electron source of claim 1, wherein the substrate is a single crystal with (111) orientation.

3. The electron source of claim 1, wherein the field emitter comprises at least one semiconductor material.

4. The electron source of claim 1, wherein at least one barrier is formed, in part, by an insulating layer that is perpendicular to the direction of charge carrier flow.

5. The electron source of claim 1, wherein the different materials are semiconductors with opposite conductivity.

6. The electron source of claim 1, wherein the field emitter comprises two coaxial parts, a broad lower part and a narrower upper part.

7. The electron source of claim 1, wherein the barrier is formed within the field emitter body.

8. The electron source of claim 1, wherein the substrate comprises an insulating layer and a conductive layer.

9. The electron source of claim 8, wherein at least one barrier is formed within the conductive layer of the substrate.

10. The electron source of claim 1, wherein the barrier is formed between the field emitter body and a conducting layer placed directly on a surface of the field emitter.

11. The electron source of claim 10, wherein the conducting layer comprises at least one semiconductor material.

12. The electron source of claim 10, wherein there is an insulating layer at least part way between the conducting layer and the surface of the field emitter.

13. The electron source of claim 10, wherein the source of the charge carriers is the conducting layer on the surface of the field emitter.

14. The electron source of claim 1, wherein an end of the field emitter comprises a narrow tip.

15. The electron source of claim 14, wherein the tip of the field emitter is sharpened and coated by diamond or diamond-like material.

16. The electron source of claim 15, wherein the diamond or diamond-like material is sharpened.

17. An electron source comprising:

a substrate;

a field emitter, a body of the field emitter configured as a whisker epitaxially grown on the substrate;

a source of charge carriers supplying the field emitter; and at least one ballast resistor configured is a junction between semiconductor materials with opposite conductivities located in or proximate to the field emitter.

18. The electron source of claim 17, wherein the substrate is a single crystal with (111) orientation.

19. A controlled electron source comprising:

a substrate having a surface and a field emitter extending from the surface;

a field emitter having a side surface with an insulating layer covering at least a portion of the side surface;

a source of charge carries supplying the field emitter;

at least one ballast resistor configured as a junction between materials with opposite conductivities located in or proximate to the field emitter; and at least one control electrode in proximity to the junction.

20. A controlled electron source of claim 19, wherein the field emitter, having a body, contains at least one active area that is at least, in part, in the body.

21. The controlled electron source of claim 19, wherein a conducting layer covers at least part of the surface of the substrate and at least part of the surface of the field emitter, the layer containing at least, in part, one or more active areas.

22. The controlled electron source of claim 19, wherein at least one control electrode is placed close enough to the junction to influence a flow of charge carriers therein.

23. The controlled electron source of claim 19, wherein at least one control electrode is separated from the field emitter by a vacuum gap.

24. The controlled electron source of claim 19, wherein at least one control electrode is placed along the side surface of the field emitter.

25. The controlled electron source of claim 24, wherein the control electrode has direct contact with the side surface of the field emitter.

26. The controlled electron source of claim 19, wherein a surface of the field emitter is coated by a material which is transparent to electrons, and which prevents outlet of chemical elements from the field emitter.

27. The controlled election source of claim 26, wherein the material comprises diamond or diamond-like carbon.

28. A matrix system of controlled electron sources arranged on a substrate, the system comprising:

at least two controlled electron sources arranged on the substrate, each of the electron sources comprising a whisker epitaxially grown on the substrate and a junction between semiconductor materials with opposite conductivities; and parallel rows of conductive material on an insulating layer covering the substrate.

29. The matrix system of claim 28, wherein the system is a two-dimensional array of the controlled electron sources arranged in rows that are approximately perpendicular to one another.

30. The matrix system of claim 28, wherein the controlled electron sources receive electrical input from two sets of approximately parallel conductive buses that are approximately perpendicular to each other and that are separated from each other by an insulating layer.

31. The matrix system of claim 28, wherein at least one electron source has a diaphragm shape and comprises conductive diamond or diamond-like material.

32. A method of preparation of a controlled electron source comprising:

forming the field emitter as a whisker epitaxially grown on the substrate;

forming within the field emitter at least one junction between materials having opposite electrical conductivities, the boundary configured approximately perpendicular to a long direction of the whisker; and forming at least one control electrode close enough to the junction to affect junction conductivity when a voltage is applied to the control electrode.

33. The method of claim 32, wherein forming the field emitter as a whisker is done using a vapor-liquid-solid method.

34. The method of claim 32, wherein forming the field emitter as a whisker comprises forming a cavity in the substrate; and depositing a solvent particle at a bottom of the cavity.

35. The method of claim 32, wherein the forming of the field emitter on a substrate comprises placing a solvent particle on the substrate and etching the substrate around the solvent particle.

36. The method of claim 32, wherein forming the field emitter comprises:

growing a whisker in a gas atmosphere that comprises elements of the substrate;

introducing doping gases into the gas atmosphere; and changing the conductivity of the doping gases at least once while forming the field emitter.

37. The method of claim 32, wherein forming the field emitter on a substrate comprises:

depositing a solvent particle onto the substrate, the substrate having a first conductivity;

using a first source material having a second conductivity opposite to the first conductivity to grow a portion of a whisker having the second conductivity;

cooling the whisker, having a globule on its end, and also cooling the substrate using an inert gas;

removing the first source material;

heating the whisker having the globule on its end using an inert gas and the substrate; and using a second source material having a first kind of conductivity to continue growing the whisker, thereby making a portion having the first conductivity.

38. The method of claim 37, wherein additional portions of the whisker are formed with alternating second and first conductivities.

* * * * *

UNITED STATES PATENT AND TRADEMARK OFFICE

CERTIFICATE OF CORRECTION

PATENT NO. : 6,861,791 B1
DATED : March 1, 2005
INVENTOR(S) : Givargizov et al.

It is certified that error appears in the above-identified patent and that said Letters Patent is hereby corrected as shown below:

Title page,
Item [56], References Cited, U.S. PATENT DOCUMENTS,
"5,090,932" reference, please delete "455/24" and insert therefor -- 445/24 --.
"5,791,959" reference, please delete "455/24" and insert therefor -- 445/24 --.

Column 10,
Line 29, please delete "is" and insert therefor -- as --.
Line 39, please delete "carries" and insert therefor -- carriers --.
Line 44, please delete "A" and insert therefor -- The --.

Column 11,
Line 1, please delete "election" and insert therefor -- electron --.

Signed and Sealed this

Eighth Day of November, 2005

JON W. DUDAS
*Director of the United States Patent and Trademark Office*